US005928081A

United States Patent [19]

Bochichio et al.

[11] Patent Number: 5,928,081

[45] Date of Patent: Jul. 27, 1999

[54] HIGH/LOW CARD GAME

[75] Inventors: Joseph V. Bochichio, Cortlandt Manor; Robert S. Pinchbeck, Mahopac Falls, both of N.Y.

[73] Assignee: Mambo Gaming Company, LLC, Peekskill, N.Y.

[21] Appl. No.: 09/045,270

[22] Filed: Mar. 20, 1998

Related U.S. Application Data

[63] Continuation-in-part of application No. 08/719,133, Aug. 25, 1997.

[60] Provisional application No. 60/042,500, Apr. 3, 1997, and provisional application No. 60/062,231, Oct. 16, 1997.

[51] Int. Cl.[6] ..... A63F 1/00

[52] U.S. Cl. ..... 463/13; 273/292

[58] Field of Search ..... 463/13; 273/274, 273/292, 309

[56] References Cited

U.S. PATENT DOCUMENTS

| | | | |
|---|---|---|---|
| 5,275,415 | 1/1994 | Wisted | 273/274 |
| 5,293,128 | 3/1994 | Marquez | 273/292 |
| 5,324,041 | 6/1994 | Boylan et al. | 273/292 |
| 5,380,012 | 1/1995 | Jones et al. | 273/292 |
| 5,810,663 | 9/1998 | Bochichio et al. | 463/13 |
| 5,813,673 | 9/1998 | Richardson | 273/292 |

OTHER PUBLICATIONS

Thomas L. Franklin, Pai Gow Poker Tommy's Way, pp. 6–30, 1989.

Scarne's Encyclopedia of Games, pp. 21–23, 1983.

*Primary Examiner*—Kien T. Nguyen
*Assistant Examiner*—Michael B. Priddy
*Attorney, Agent, or Firm*—Natter & Natter

[57] ABSTRACT

A card game affords each player an opportunity to wager his hand as having a poker rank higher or lower than all other players. A dealer deals a first deal of one card face down to each player followed by a second deal of one card face up to each player. Thereafter, players either wager or fold. The dealer then proceeds to deal one card face down to all remaining players and places one card face up on the table as a community card available to all players. After a further round of wagering, the face down cards of all players are exposed and a high hand winner is selected as the player having the highest rank three card hand among all players. Similarly, the low hand winner is selected as the player having the best low rank three card hand among all players. The total pot of wagers is divided between the high hand and best low hand winners.

20 Claims, 4 Drawing Sheets

HIGH/LOW CARD GAME

RELATED APPLICATIONS

This application is a continuation-in-part of Application Ser. No. 08/719,133, filed Aug. 25, 1997 and also claims the benefit of U.S. provisional application Ser. No. 60/042,500, filed Apr. 3, 1997 and U.S. provisional application Ser. No. 60/062,231, filed Oct. 16, 1997.

BACKGROUND OF THE INVENTION

1. Field of the Invention

This invention relates generally to card games and more particularly to high/low poker variant card games.

2. Antecedents of the Invention

Card games, and particularly poker, are commonly played throughout the world. Poker provides an exciting pastime for social groups, and ranks relatively high in the diverse variety of leisure time entertainment activities.

Poker itself is not a single game within the confines of a strict set of rules but, the term "poker" has been applied to a variety of games, i.e. variants, played with differences in rules. The principle rules of play of poker, however, have been the same for all variants and can be classified in four groups: draw, stud, low ball and mixtures, such as high/low.

Generally, the winner of a round in a poker game is the player who has the best poker hand among those players who have remained in the game. The hand in almost all variants of poker comprises five cards which are ranked as follows, from the highest order to the lowest order:

1. Royal Flush (all cards of the same suit in sequence, from Ace through 10);
2. Straight Flush (all cards of the same suit in sequence);
3. Four of a Kind (four cards of the same rank);
4. Full House (three cards of one rank, two cards of another rank);
5. Flush (all cards of the same suit, not in sequence);
6. Straight (all cards in sequence, not of the same suit);
7. Three of a Kind (three cards of one rank);
8. Two pairs (two cards of one rank, two cards of another rank);
9. One Pair (two cards of one rank); and
10. High Card (no combination).

There remained a need for a poker variant game suitable for card table play which would be played with a reduced number of cards in a hand, which would afford multiple wagering opportunities and reduced play duration for each round, which would also provide enhanced entertainment features by affording players an opportunity to simultaneously play for a high winning hand or a low winning hand and which would include an opportunity for players to employ strategies.

SUMMARY OF THE INVENTION

The present invention relates to a variant poker game wherein each individual player positioned around a table is afforded an opportunity to wager that his/her hand has a poker rank either highest or lowest of all remaining players.

A dealer controls the distribution of cards to all players, wagering and the determination of winning hands.

Each player is dealt one card face down and one card face up. Wagering follows after which each remaining player is dealt one card face down, followed by further wagering.

The dealer then places one card face up as a community card available to all remaining players, followed by a further round of wagering.

All hands are then exposed and the dealer determines which player has the highest three card hand from among each player's three dealt cards and the community card and which player has the best low ranking hand, i.e. lowest value of a three card hand from among all players having a low qualifying hand, i.e. a low hand with no pairs, a low straight or a low flush having a high card of six or less. The total pot of the antes and wagers is divided between the high hand and the low hand winners. In the event no player's hand qualifies as a low ranking hand, the player with the winning high hand takes the entire pot.

From the foregoing compendium, it will be appreciated that it is an aspect of the present invention to provide a high/low card game of the general character described which is not subject to the disadvantages of the antecedents aforementioned.

It is a feature of the present invention to provide a high/low card game of the general character described which is simple to play.

A consideration of the present invention is to provide a high/low card game of the general character described which is entertaining.

Another feature of the present invention is to provide a high/low card game of the general character described wherein players are afforded high and/or low hand wagering options.

A further aspect of the present invention is to provide a high/low card game of the general character described which is particularly well suited for play at gaming establishments.

To provide a high/low card game of the general character described which embodies a wagering structure that accommodates conservative as well as aggressive styles of play is another aspect of the present invention.

A further feature of the present invention is to provide a high/low card game of the general character described which is equally challenging to both experienced and novice players.

Another consideration of the present invention is to provide a high/low card game of the general character described wherein effective wagering is premised upon strategic considerations.

Yet another aspect of the present invention is to provide a high/low card game of the general character described which proceeds at a rapid pace while affording wagering opportunities.

A further feature of the present invention is to provide a high/low card game of the general character described which is easy to learn.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations and certain other aspects, features and considerations are attained, all with reference to the accompanying drawings and the scope of which will be more particularly pointed out in the appended claims.

BRIEF DESCRIPTION OF THE DRAWINGS

In the accompanying drawings in which are shown some of the various possible exemplary embodiments of the invention.

DESCRIPTION OF THE PREFERRED EMBODIMENTS

Figure 1:
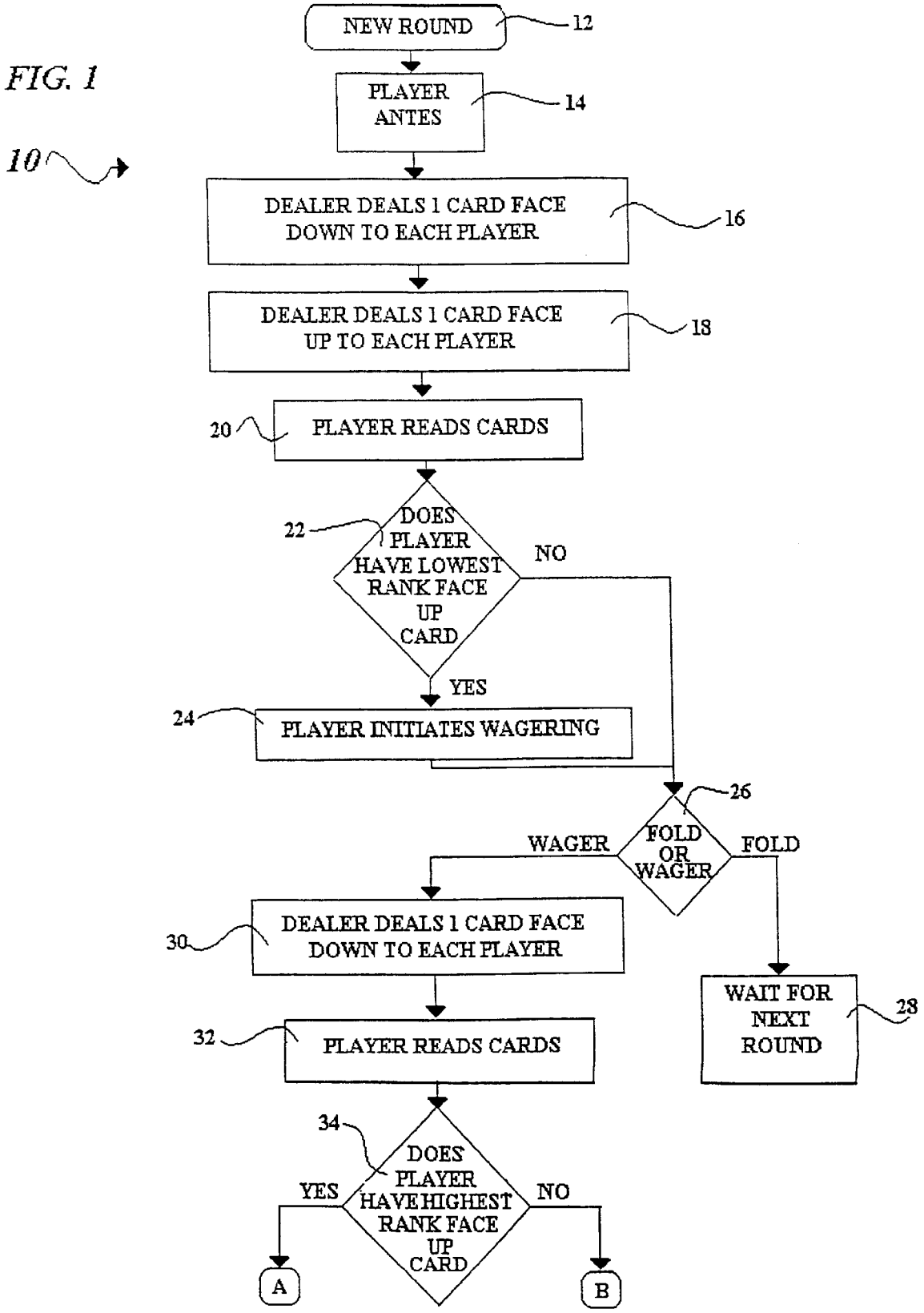
FIG. 1 is a schematized flow chart depicting the various steps in the play of a high/low card game in accordance with the invention.

The high/low card game of the present invention comprises a variant poker game wherein each individual player is afforded an opportunity to wager that his hand has a poker rank either higher and/or lower than all other players. The game is preferably played with a standard poker deck of fifty two cards with each player positioned around a table capable of accommodating up to approximately 10 players.

Pursuant to the invention, each player is dealt a total of three cards and for the purposes of determining winning hands, each player may utilize a community card which is common to all players, with winning hands determined on the basis of the best three out of four available cards of each player.

If the game is played in a gaming establishment, the game is controlled by a dealer who does not participate in the game play but serves only to distribute cards and determine winning hands and pay outs.

Referring now in detail to the drawings, the reference numeral 10 depicts a flow chart illustrating the steps employed in playing the high/low card game of the present invention. At the commencement of each new round, designated by the numeral 12, each player contributes to the pot an ante comprising one or more chips or tokens having predetermined value, in accordance with established house rules as indicated in a box 14.

The dealer shuffles the deck and deals one card face down to each player, proceeding from left to right, as indicated in a block 16. The dealer then follows by dealing one card face up to each player, proceeding from left to right, as indicated in a block 18.

At this point, each player may read his/her face down card as indicated in a block 20.

The dealer then determines which player has the lowest rank face up card, as indicated in a query block 22. The player with the lowest rank face up card initiates wagering with one or more tokens or chips in accordance with predetermined minimum and maximum wager rules, as indicated in a block 24, while the remaining players, proceeding from the left of the initiating player either folds, thus forfeiting the ante, or wagers by calling or raising, as indicated in a query block 26. In the event the player folds, he or she then waits for the next round as indicated in a block 28. The initiating wager and all other wagers are placed into the pot.

The remaining players are dealt an additional card face down by the dealer as indicated in a block 30. Thereafter, the players read their cards, as indicated in a block 32, and a determination is made as to which player has the highest rank face up card as indicated in a query block 34.

The player with the highest rank face up card is then afforded an opportunity to initiate a second round of wagering, as indicated in a block 36 while the remaining players determine whether or not to fold or to wager by calling or raising, as indicated in a query block 38. Players who fold are no longer in the play of the game and must wait for the next round as indicated in a block 40. All second round wagers are placed into the pot.

After the second round of wagering, the dealer places one common or community card face up on the table as indicated in a block 42. The community card is available to all players in determining winning hands of the highest and lowest ranking of the best 3 cards.

An inquiry is then made with respect to each player having the highest ranking two face up cards as indicated in an inquiry block 44 and that player is provided an opportunity to initiate a final round of wagering as indicated in a block 46.

The remaining players are given the opportunity to either fold or wager by calling or raising as indicated in an inquiry block 48. All final round wagers are placed into the pot. Those players folding are out of the play and are required to wait for the next round as indicated in a block 50.

All players then expose their face down cards as indicated in a block 52. A determination is then made by the dealer which player has the highest ranking three card hand out of each player's available cards (including the community card) as indicated in a block 54. The player with the highest ranking hand is awarded one half the pot as indicated in a block 56.

A determination is then made if any player has a qualifying low hand of three cards out of each player's four available cards as indicated in an inquiry block 58.

If no player's hand qualifies as a low hand, i.e. a low hand with no pairs, a low straight or a low flush with a high card of six or less, the high hand winner determined in block 54 takes the remainder of the pot, as indicated in a block 60.

If there is a qualifying low hand, a determination is then made as to which player's qualifying hand has the best low ranking, as indicated in inquiry block 62.

The best low ranking hand is then awarded one half of the pot as indicated in a block 66 while the remaining players wait for the next round of play as indicated in a block 64.

Thereafter, the next round of play proceeds by entering into block 12.

It should be appreciated that many possible variations in sequence of steps without departing from the invention are evident.

For example, the reading of cards (block 20 and block 32) may take place prior to initiating wagering, rather than prior to determining who will initiate wagering.

Similarly, the determination as to who will initiate wagering (block 22, block 34 and block 44) may be made arbitrarily or in any alternate manner without affecting the play.

Ranking of the winning hands pursuant to the invention is similar to the ranking of poker hands. Pursuant to the present invention, the best three card hands out of four available cards for each player may be ranked as follows, from the highest order to the lowest order:

FIRST: ace, king, queen of the same suit (Royal Flush);

SECOND: three cards of the same suit in sequence (Straight Flush);

THIRD: three cards of one rank (Three of a Kind);

FOURTH: straight-three cards in sequence, not of the same suit (Straight);

FIFTH: three cards of the same suit, not in sequence (Flush);

SIXTH: two cards in one rank (One Pair);

SEVENTH: no combination (High Card).

Low hands are ranked, in descending order as follows:

FIRST: three, two, ace;

SECOND: four, two, ace;

THIRD: four, three, ace;

FOURTH: four, three, two;

FIFTH: five, two, ace;

SIXTH: five, three, ace;

SEVENTH: five, three, two;

EIGHTH: five, four, ace;

NINTH: five, four, two;

TENTH: five, four, three;

—through—

LAST: six, five, four.

Figure 4:
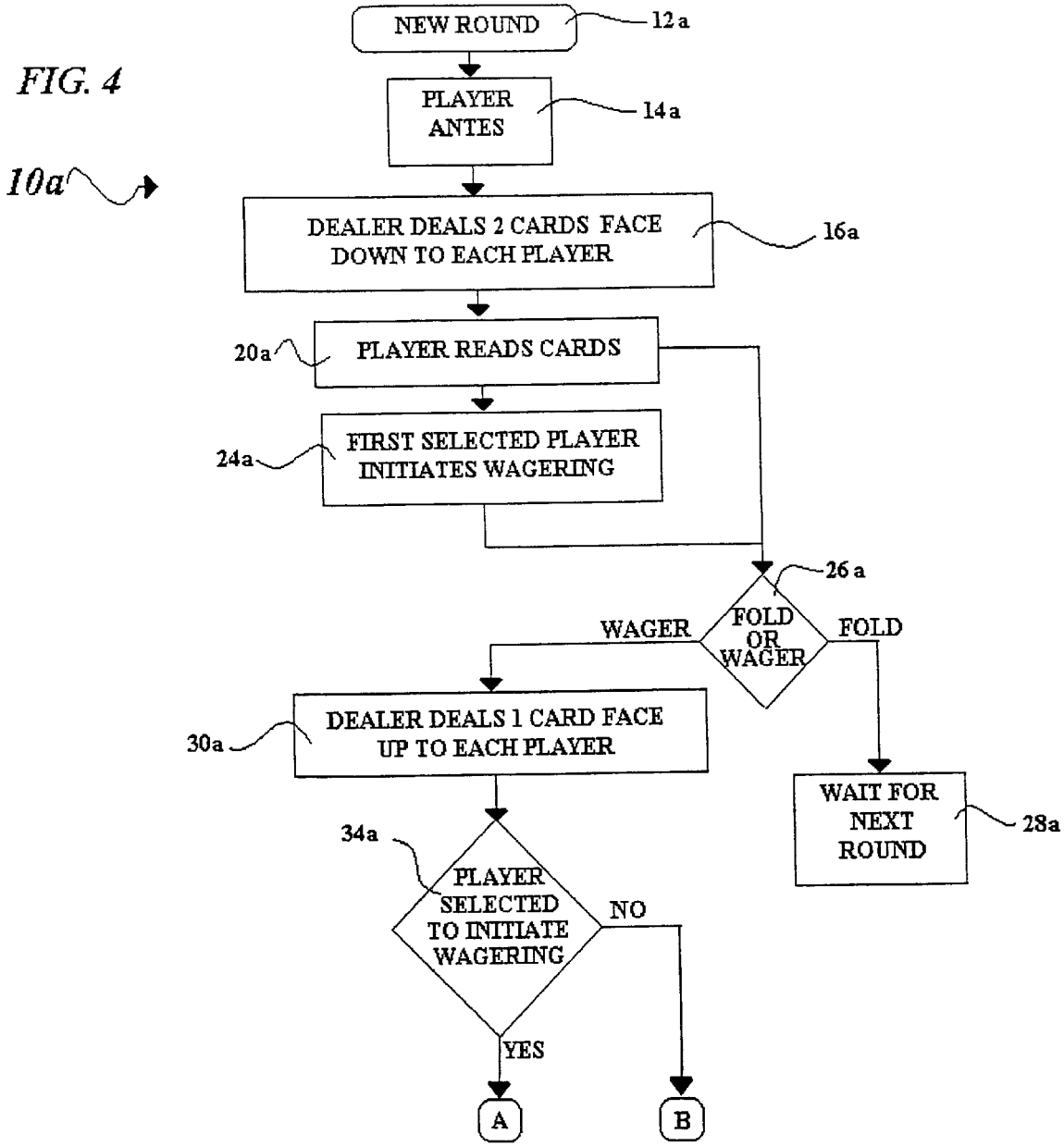
FIG. 4 is a schematized flow chart depicting the various steps in the play of an alternate embodiment of the invention.

A further embodiment of the invention is illustrated in FIG. 4. This embodiment is similar to the embodiment previously described. The various steps illustrated in the flow chart of FIG. 4 employ common numerals as the corresponding steps depicted and described with reference to the previous embodiment, however, bearing the suffix "a".

In this embodiment, winning hands of the highest rank and best low rank are determined in the same manner, that is the winners are the players having the highest rank and best low rank of three cards among three dedicated cards dealt to the players plus a common community card.

There is, however, in this further embodiment, a variation in the manner of dealing the cards. More specifically, each player is initially dealt two cards face down. A first round of wagering then commences, followed by each player being dealt one card face up, after which a second round of wagering takes place. This, in turn, is followed by the dealer dealing the common community card, followed by a third round of wagering.

Referring now in detail to FIG. 4, wherein a flow chart 10*a* is depicted, each new round 12*a* is commenced with each player placing an ante into a common pot as indicated in a block 14*a*. Thereafter, a dealer deals each player two cards face down as indicated in a block 16*a*. The players thereafter read their respective cards, as indicated in a block 20*a*.

A player designated by the dealer or otherwise determined by house rules initiates wagering as indicated in a block 24*a* and the remaining players then determine whether or not to fold or wager (by calling or raising) as indicated in an inquiry block 26*a*. Those players who have folded are required to wait for the next round as indicated in a block 28*a* and the dealer deals one card face up to each remaining players as indicated in a block 30*a*.

A determination is then made as to which player is to initiate a second round of wagering. This determined as indicated in an inquiry block 34*a*. This designation may be made by the dealer or house rules. For example, the player selected may be the player to be left of the player who initiated the previous round of wagering or may comprise the player having the lowest rank face up card or the player with the highest rank face up card or cards.

Figure 2:
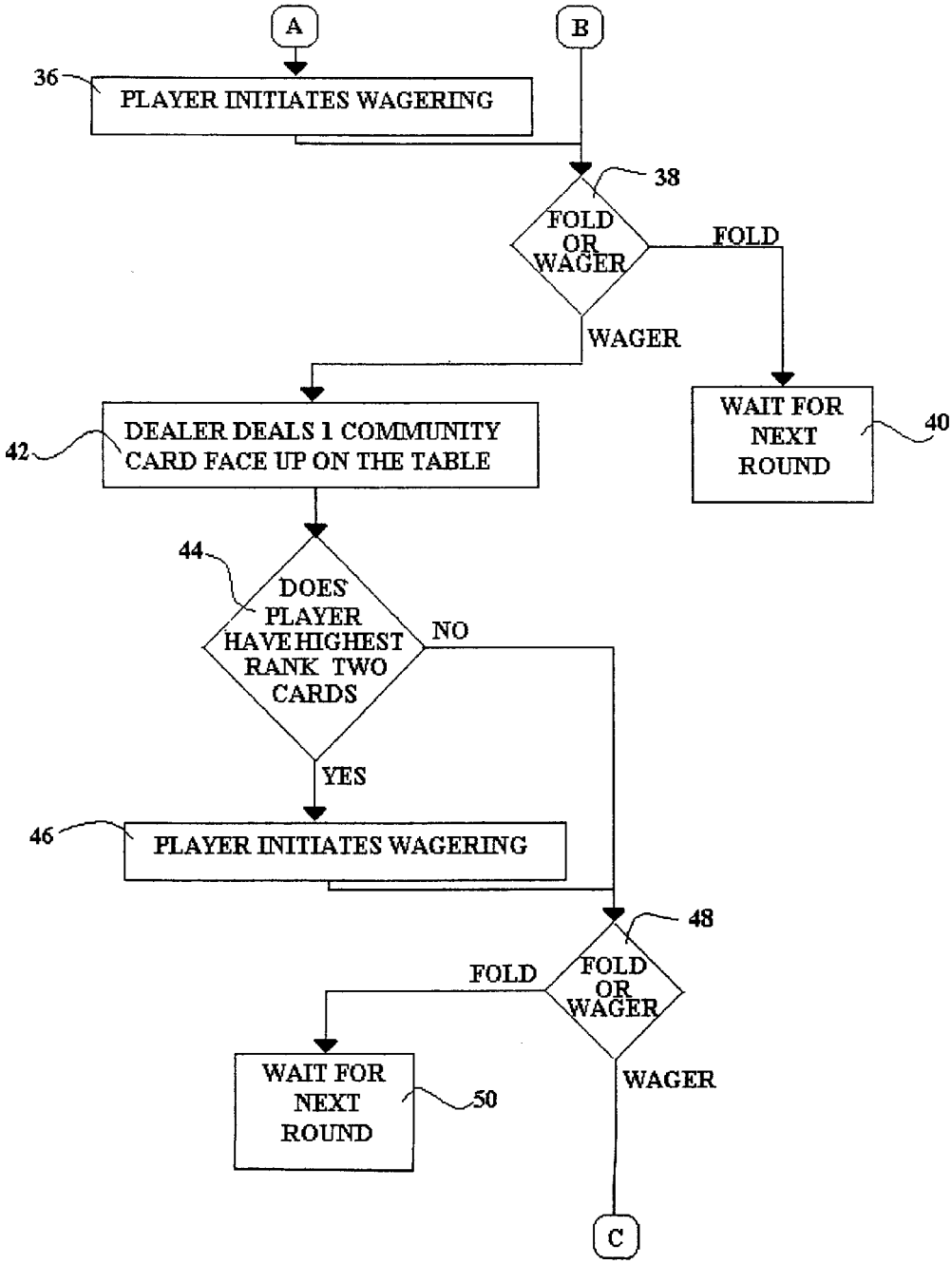
FIG. 2 is a continuation of the flow chart of FIG. 1.
Figure 3:
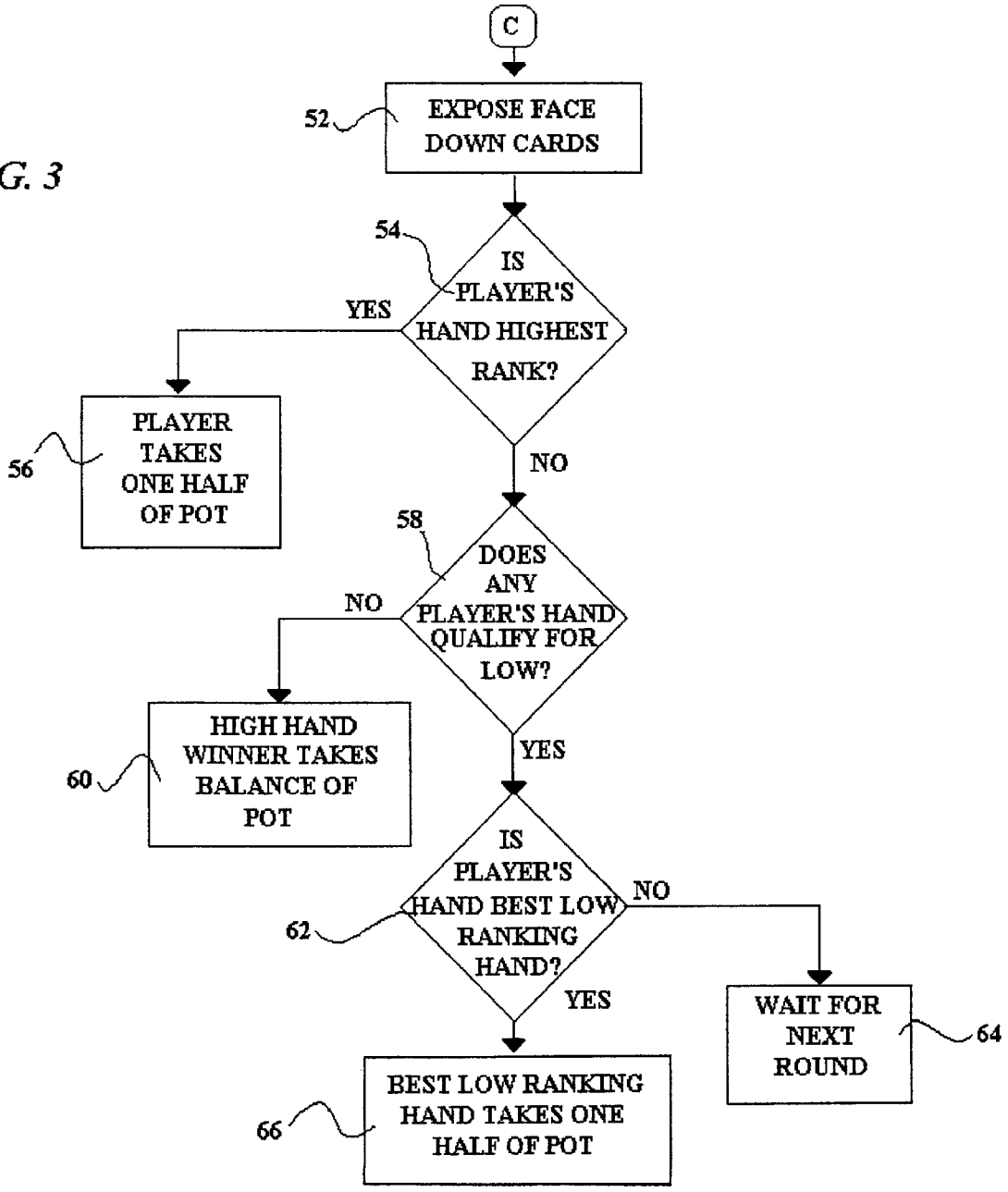
FIG. 3 is a further continuation of the flow chart of FIG. 1 and FIG. 2.

After the determination is made as to which player initiates the second round of wagering, the card game of the alternate embodiment proceeds into the identical steps of the flow chart depicted in FIGS. 2 and 3.

It should be appreciated that various modifications and variations will be readily apparent without departing from the spirit of the invention. For example, modification in the order of ranking of winning high and low hands may be made, such as, not considering low straights and low flushes as qualifying for low hands. In such instance, the best low hand would comprise a four, two and ace. Changes in the qualifications for a low hand and elimination of the requirement for low hand qualification are also apparent. Further, changes may be made in the proportionate sharing of the pot by the high and low hand winners. Additionally, the game can be played without a nonplaying dealer. Other variations include alternate means for determining the player who initiates each round of wagering.

Thus it will be seen that there is provided a high/low card game which achieves the various aspects, features and considerations of the present invention and which is well suited to meet the conditions of practical usage.

As various changes might be made in the high/low card game above set forth, it is to be understood that all matter herein described and shown in the accompanying drawings is to be interpreted as illustrative and not in a limiting sense.

Having thus described the invention there is claimed as new and desired to be secured by Letters Patent:

1. A method of playing a high/low card game comprising the steps of:

a) a player placing an ante, b) a dealer dealing a first deal of at least one face down card to each player, c) the dealer dealing a second deal of at least one face up card to each player, d) each player examining the at least one card of the first deal, e) a first player initiating a first round of wagering, f) each of the other players either folding or wagering, g) the dealer dealing a third round of at least one face down card to each player who has not folded in step f), h) each player examining the at least one card of the third deal, i) a second player initiating a second round of wagering, j) each of the other players who has not folded in step f) either folding or wagering, k) the dealer dealing a fourth deal of one common face up card, l) a third player initiating a third round of wagering, m) each of the other players who have not previously folded, either folding or wagering, n) each player exposing the cards dealt to the player in the first deal and the third deal, o) selecting, the highest rank of each three card hand from among the three cards dealt to each player and the community card, p) awarding to the player with the highest rank among all players, winnings comprising at least a portion of all antes and wagers.

2. A method of playing a high/low card game in accordance with claim 1 wherein the first deal comprises one face down card.

3. A method of playing a high/low card game in accordance with claim 1 wherein the second deal comprises one face up card.

4. A method of playing a high/low card game in accordance with claim 1 wherein the third deal comprises one face down card.

5. A method of playing a high/low card game in accordance with claim 1 wherein the first deal comprises one face down card, the second deal comprises one face up card and the third deal comprises one face down card.

6. A method of playing a high/low card game in accordance with claim 1 further including:

q) selecting, the best low rank of each three card hand from among the three cards dealt to each player and the community card, r) comparing the best low rank of each player's hand to the best low rank of all other player's hands and awarding to the player with the best low rank among all players, winnings comprising at least a portion of all antes and wagers.

7. A method of playing a high/low card game in accordance with claim 6 wherein the winnings of the player with the highest rank among all players comprises one-half of all antes and wagers and the winnings of the player with the best low rank among all players comprises one-half of all antes and wagers.

8. A method of playing a high/low card game in accordance with claim 1 further including:

q) selecting, the best low rank of a hand of a number of cards comprising the number of cards dealt to each player in the first, second and third deals plus the community card, r) determining if the best low rank of any player meets predetermined qualifications, and s) if the predetermined qualifications are not met, awarding to the player with the highest rank among all players, winnings comprising a further portion of all antes and wagers, t) if the best low rank of any player's hand meets the predetermined qualifications, comparing the best low rank of each player's hand to the best low rank of all other player's hands and awarding to the player with the best low rank among all players, winnings comprising a portion of all antes and wagers.

9. A method of playing a high/low card game in accordance with claim 8 wherein the portion set forth in step p) comprises one-half the antes and wagers, and the portions set forth in step s) and step t) comprises one-half the antes and wagers.

10. A method of playing a high/low card game in accordance with claim 1 wherein the first player is selected based upon the rank of the card dealt to such player on the second deal.

11. A method of playing a high/low card game in accordance with claim 1 wherein the second player is selected based upon the rank of the card dealt to such player in the second deal.

12. A method of playing a high/low card game in accordance with claim 8 wherein the predetermined qualifications comprises a no combination hand with a high card of six or less.

13. A method of playing a high/low card game in accordance with claim 12 wherein the predetermined qualification also includes a low straight and a low flush.

14. A method of playing a high/low card game in accordance with claim 8 wherein a player whose hand meets certain qualifications, may qualify for both a high winning hand and the best low rank hand among all players.

15. A method of playing a high/low card game in accordance with claim 14 wherein the certain qualifications comprise a no combination hand with a high card of six or less or a hand having a value of a low straight or a low flush.

16. A method of playing a high/low card game with a plurality of players, the method comprising the steps of:

a) a dealer dealing a total of two cards face down and one card face up to each player, b) all players wagering or folding, c) the dealer dealing one community card face up to all remaining players, d) all remaining players either wagering or folding, e) all remaining players exposing their face down cards, f) determining from among all players, the highest rank of each three card hand from among the three cards dealt to each player and the community card, g) determining from among all players, the best low rank of each three card hand from among the three cards dealt to each player and the community card, and h) allocating winnings comprising the total value amount of all wagers among the player with the highest rank hand among all players and the player with the best low rank hand among all players.

17. A method of playing a high/low card game with a plurality of players in accordance with claim 16 wherein step a) is performed by sequentially dealing one card face down, one card face up and one card face down.

18. A method of playing a high/low card game with a plurality of players in accordance with claim 17 further including the step of all players wagering or folding after the face up card is dealt in step a).

19. A method of playing a high/low card game with a plurality of players in accordance with claim 16 wherein step a) is performed sequentially by dealing one card face down, one card face down and one card face up.

20. A method of playing a high/low card game with a plurality of players in accordance with claim 19 further including the step of all players wagering after the second face down card is dealt.

* * * * *